US007003809B1

(12) United States Patent
Gordon

(10) Patent No.: US 7,003,809 B1
(45) Date of Patent: Feb. 28, 2006

(54) CAP WITH A TAPERED EXTERIOR POCKET

(76) Inventor: Allan Gordon, 65 Saxton Dr., Hackettstown, NJ (US) 07840

( * ) Notice: Subject to any disclaimer, the term of this patent is extended or adjusted under 35 U.S.C. 154(b) by 0 days.

(21) Appl. No.: 10/454,911

(22) Filed: Jun. 5, 2003

Related U.S. Application Data

(60) Provisional application No. 60/442,185, filed on Jan. 23, 2003.

(51) Int. Cl.
*A42B 1/24* (2006.01)

(52) U.S. Cl. ..... 2/209.13

(58) Field of Classification Search ..... 2/247, 2/250, 209.13, 195.1–195.3; 224/181, 918, 224/251; 362/103, 105, 106, 570
See application file for complete search history.

(56) References Cited

U.S. PATENT DOCUMENTS 4,179,753 A * 12/1979 Aronberg et al. ..... 2/10
4,312,076 A 1/1982 Gamm
4,776,044 A 10/1988 Makins
5,003,637 A * 4/1991 Lonon ..... 2/160
5,102,024 A * 4/1992 Boersma et al. ..... 224/181
5,253,368 A * 10/1993 Blake ..... 2/209.13
5,452,479 A * 9/1995 Mostert ..... 2/195.1
5,548,847 A 8/1996 Spicijaric
5,581,813 A 12/1996 Henschel
5,724,678 A 3/1998 McCallum et al.
5,860,167 A * 1/1999 Lizio ..... 2/209.13
5,894,604 A 4/1999 Crabb et al.
5,933,871 A 8/1999 Kraft
6,023,788 A 2/2000 McCallum et al.
6,230,331 B1 5/2001 Agullar et al.
6,237,159 B1 * 5/2001 Martin ..... 2/209.12
6,247,177 B1 * 6/2001 Hayes ..... 2/12
6,264,079 B1 * 7/2001 Skaggs ..... 224/193
6,314,583 B1 11/2001 Cho
6,317,892 B1 11/2001 Galigani
6,647,554 B1 * 11/2003 Yan ..... 2/209.13

FOREIGN PATENT DOCUMENTS

WO WO 99/45806 9/1999

* cited by examiner

*Primary Examiner*—Katherine M. Moran
(74) *Attorney, Agent, or Firm*—Mathews, Shepherd, McKay & Bruneau, P.A.

(57) ABSTRACT

An improved cap has an open tapered exterior pocket for easily securely storing a marking device. The marking device, such as a pencil, pen, felt tip market, etc. readily accessible is highly accessible while at the same time safely secured on the user.

15 Claims, 3 Drawing Sheets

CAP WITH A TAPERED EXTERIOR POCKET

CROSS REFERENCES TO RELATED APPLICATIONS

This application claims the benefit under 35 U.S.C. 119(e) of U.S. Provisional Application Ser. No. 60/442,185, entitled Hat/Cap With A Tapered Exterior Pocket, filed on Jan. 23, 2003.

FIELD OF INVENTION

The present invention relates to an article of clothing and more particularly to a cap having a storage pocket.

BACKGROUND OF THE INVENTION

When working at a construction site, in a food service business such as a deli, when golfing, or engaging in a variety of work and pleasure activities there is frequently a need to have a marking device such as a pencil, pen, felt tip market, etc. readily accessible. While some individuals store such marking devices in a pants or shirt pocket, this is inconvenient and may damage the clothing pocket by puncture and or leakage. Furthermore, a sharp marking device may scrape or even puncture the skin of the user.

One trick that is often employed is to hold a pencil between the ear and head of the user, where the ear provides suitable tension. Alternatively, individuals with very curly hair may place the pencil directly in their hair. However this significantly limits the size and type of marking device that can be held, is not very secure and can be quite uncomfortable to some individuals.

Therefore it is desirable to be able to have a marking device highly accessible, secured on the user such as in a particular item of clothing.

SUMMARY OF THE INVENTION

The present invention is an improved cap having an open tapered exterior pocket for securely storing an item such as a marking device.

BRIEF DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

The present invention is an improved cap (cap/hat) having an open tapered exterior pocket for securely storing a marking device a device. Although the improved cap having an open tapered exterior pocket for securely storing a marking device is particularly well suited for use as a sports type cap and will be so described herein, it is equally well suited for use with other types of head wear, including a hat, hat with integrated ear muffs, hard hat as well as other types of hats.

The improved cap having an open tapered exterior pocket for securely storing a marking device while shown with the open tapered pocket on one side is equally well suited for having an open tapered pocket on the other side and/or on both sides, thus providing an optimal configuration for both left handed and right handed individuals as well as enabling the secure accessible storage of more than one writing device at the same time (or even the storage of sunglasses or eyeglasses). The marking device can be easily removed and replaced using a natural body motion similar to that used to place the marking device behind a user's ear.

Figure 1:
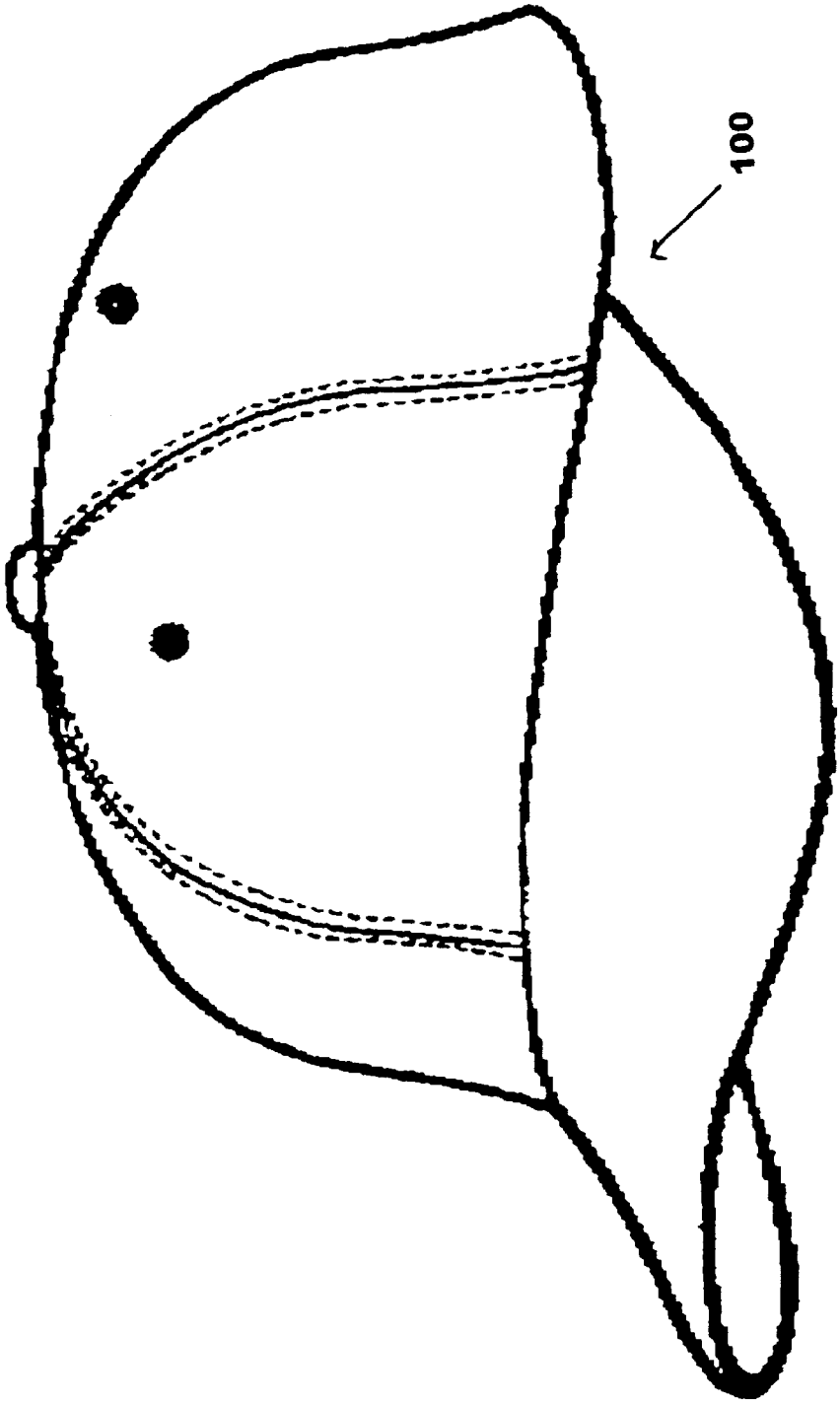
FIG. 1 is a perspective view of a conventional sports cap.

Referring to FIG. 1 there is shown a perspective view of a conventional sports cap 100, where the user's ears are exposed, and the user's ears may be used to hold a marking/writing device.

Figure 2:
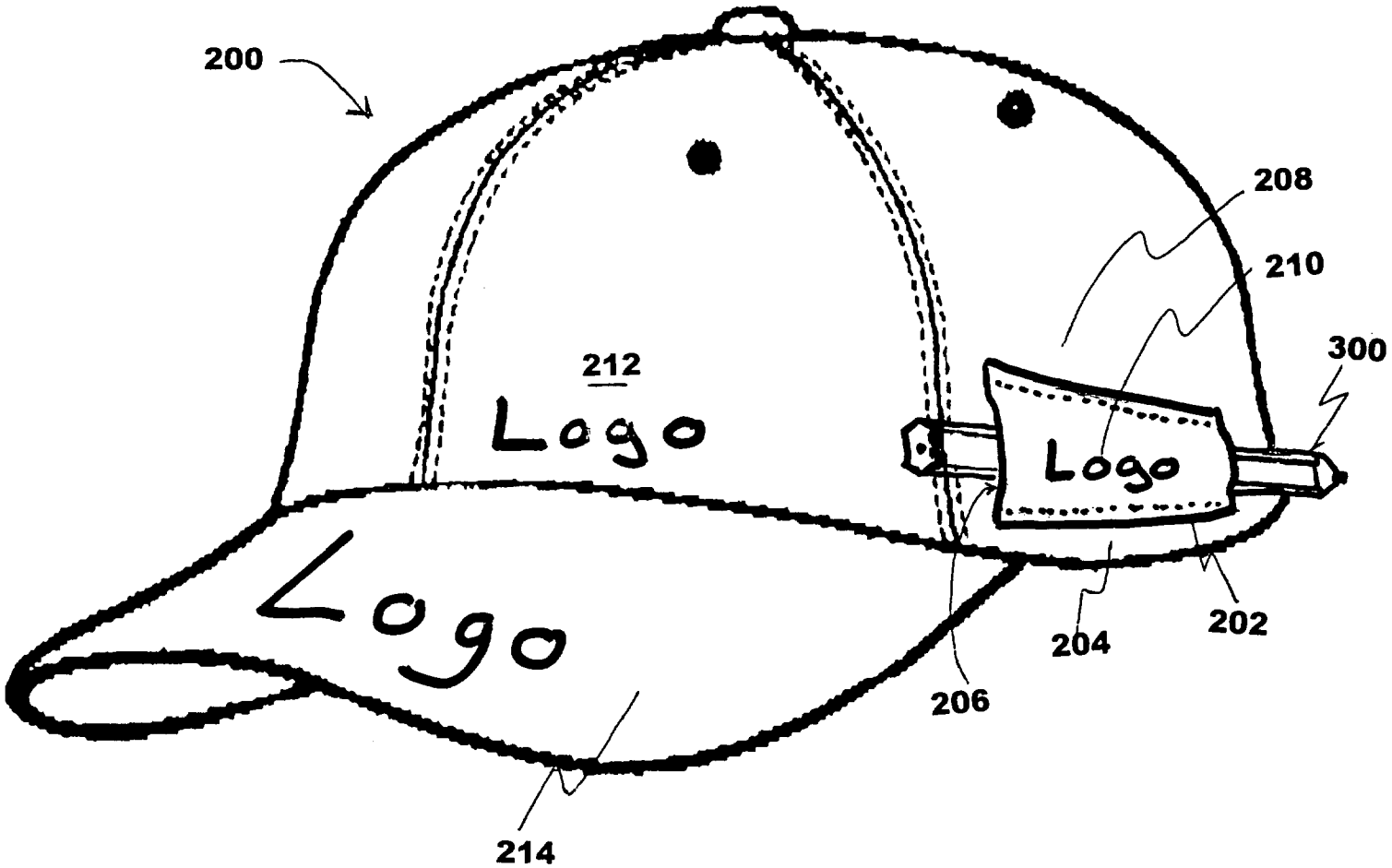
FIG. 2 and FIG. 3 are perspective views of one embodiment of the improved cap having an open tapered exterior pocket for securely storing a marking device.

Referring to FIG. 2 there is shown a perspective view of one embodiment, a sports type cap, of the improved cap having an open tapered exterior pocket for securely storing a marking device. The improved cap having an open tapered exterior pocket 200. An open tapered pocket 202 is located at or slightly above the brim 204 of the cap. The open tapered pocket 202 may be made of leather, suede, plastic or other suitable cloth or material. In one preferred embodiment of improved cap having a open tapered exterior pocket 200, the open tapered pocket 202 is made of leather, with the rough surface side 206 of the leather positioned towards the exterior side 208 surface of the cap 200 with the smooth or polished surface being positioned to be the exterior side of the tapered pocket 210 positioned away from the exterior side 208 of the cap 200. The tapered pocket 202 is attached by stitching through the exterior side 208 of the cap 200. Alternatively the tapered pocket 202 may be glued, bonded, welded, clipped, stapled, snapped, riveted or attached with hook and loop fasteners on to the cap 200 using techniques suitable for the particular materials that would be known to one skilled in the art of clothing design and manufacture.

The tapered design of the exterior pocket 202 and additionally by positioning the rough surface side 206 of the leather positioned towards the exterior side 208 of the cap 200, the marking device 300 is securely held in place, easily accessible, as well as can accommodate a variety of shapes and sizes of marking devices 300. When a marking device 300 is inserted into the open tapered pocket 202 located at or slightly above the brim 204 of the cap 200 the marking device 300 can be easily inserted, with frictional resistance progressively increasing both as a function of decreasing size of the pocket cross-section and the length of the insertion as the marking device 300 is inserted further into and then through the open tapered pocket 202. When part of a soft cap 200, the crown of the cap also flexes for easy insertion of the marking device 300. As one end of the open tapered pocket 200 is larger than the other open end, the larger open end is used for inserting the marking device 300, providing an easier target, for fast safe insertion. If the pocket was not tapered, the open ends would be uniform and would either compromise the ease of insertion or the strength of holding, whereas the present invention improved cap having an open tapered exterior pocket 200 simultaneously provides ease of insertion with strength of holding.

The improved cap having an open tapered exterior pocket 200 is particularly well suited for use as a promotional/advertising media, with the advertising indicia placed on the front of the cap 212, the brow of the cap 214. Alternatively advertising indicia may be placed directly on the exterior of side of the tapered pocket 210. Properly conditioned, the exterior of side of the tapered pocket 210 may be used to mark or indicate the name of the owner of the cap. A combination of positions and types of indicia may also be used.

Figure 3:
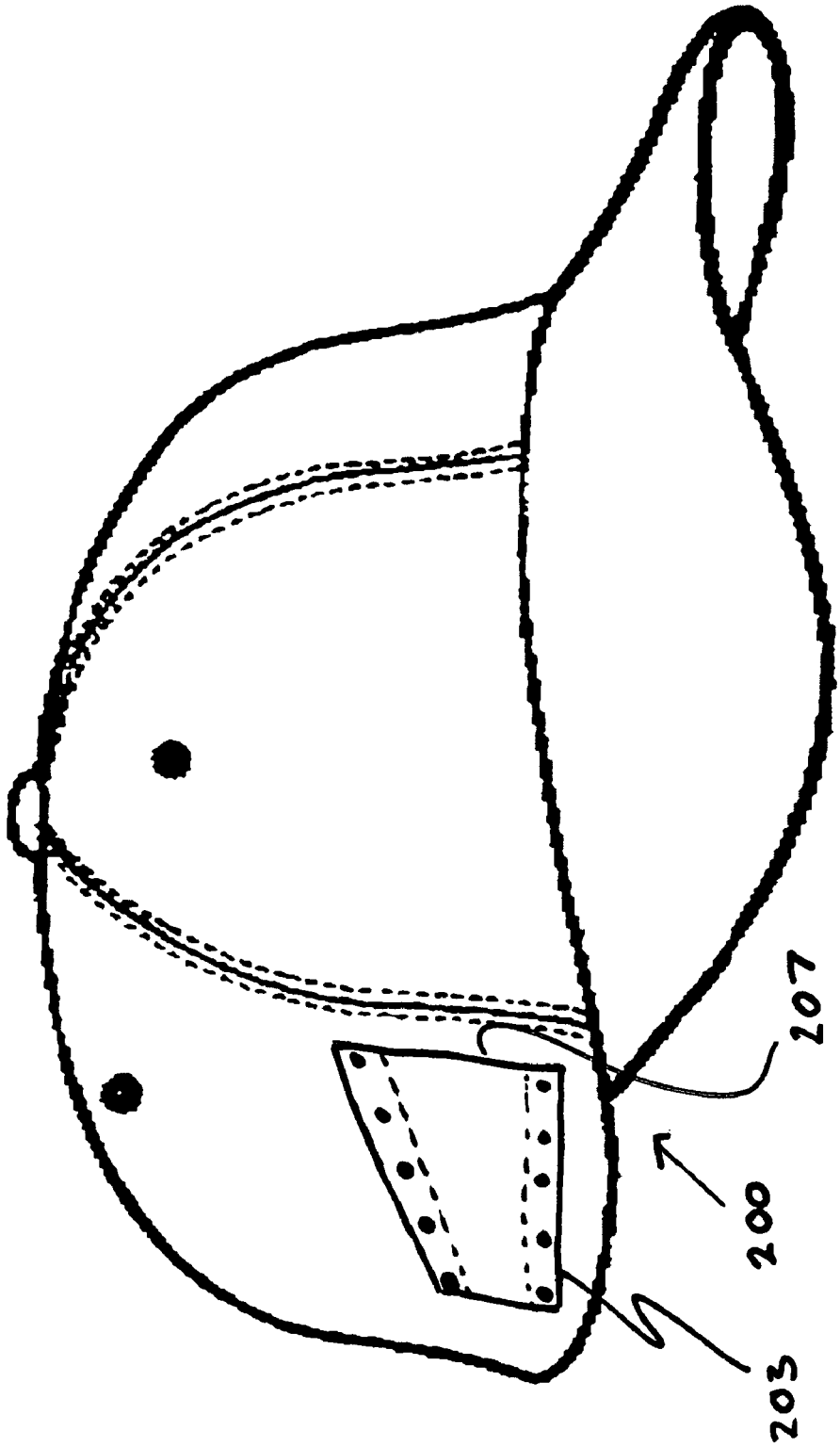

Referring to FIG. 3 there is shown a perspective view of the opposite side of the embodiment shown in FIG. 2 of the improved cap having an open tapered exterior pocket for securely storing a marking device. The crown of the cap 200 may be made of a flexible material or of an impact resistant material. When the cap 200 contains a second tapered pocket 203 on the opposite side of the crown from the first tapered pocket 202 the second tapered pocket 203 can have a larger opening 207 than the first tapered pocket 202 has, thus providing even greater flexibility to the sizes of the objects secured.

Numerous modifications and alternative embodiments of the invention will be apparent to those skilled in the art in view of the foregoing description, such as but not limited to the crown being made of a rigid impact resistant material. Accordingly, this description is to be construed as illustrative only and is for the purpose of teaching those skilled in the art the best mode of carrying out the invention. Details of the structure may be varied substantially without departing from the spirit of the invention and the exclusive use of all modifications, which come within the scope of the appended claims, is reserved.

What is claimed is:

1. An improved cap for securely storing an item such as a marking device capable of having various diameters comprising:

a crown;

a visor attached to the crown; and a first piece of tapered pocket material permanently attached to an exterior side of the crown, wherein the first piece of tapered pocket material defines a first tapered pocket having at least two openings, one opening larger and one opening smaller;

a second piece of tapered pocket material permanently attached to an opposite exterior side of the crown, wherein the second piece of tapered pocket material defines a second tapered pocket having at least two openings, one opening larger and one opening smaller;

wherein the second piece of tapered pocket material is larger than the first piece of tapered pocket material such that the second tapered pocket is larger than the first tapered pocket.

2. The improved cap as recited in claim 1 wherein the first tapered pocket material is leather.

3. The improved cap as recited in claim 2 wherein the leather has a smooth surface and a rough surface and the first tapered pocket material is positioned such that the rough surface is towards the crown.

4. The improved cap as recited in claim 1 wherein the first tapered pocket material is cloth.

5. The improved cap as recited in claim 1 wherein the first tapered pocket material is elastic.

6. The improved cap as recited in claim 5 wherein the elastic is in a released state when the first tapered pocket is empty.

7. The improved cap as recited in claim 1 wherein the crown comprises flexible material.

8. The improved cap as recited in claim 1 wherein the crown comprises rigid impact resistant material.

9. The improved cap as recited in claim 1 wherein the larger opening of the first tapered pocket is aligned towards the visor.

10. The improved cap as recited in claim 1 wherein the exterior of the first piece of tapered pocket material has promotional indicia.

11. The improved cap as recited in claim 1 wherein the crown further comprises a mechanism for adjustment of size.

12. The improved cap as recited in claim 1 wherein the first piece of tapered pocket material is permanently attached to the exterior side of the crown by stitching.

13. The improved cap as recited in claim 1 wherein the first piece of tapered pocket material is permanently attached to the exterior side of the crown by a mechanical fastener.

14. The improved cap as recited in claim 1 wherein the exterior of the crown has promotional indicia.

15. The improved cap as recited in claim 1 wherein the visor has promotional indicia.

* * * * *